US011462833B2

(12) United States Patent
Niroo Jazi et al.

(10) Patent No.: US 11,462,833 B2
(45) Date of Patent: Oct. 4, 2022

(54) MILLIMETER-WAVE PHASED-ARRAYS WITH INTEGRATED ARTIFICIALLY PILLOWED INVERTED-L ANTENNAS

(71) Applicant: PERASO TECHNOLOGIES INC., Toronto (CA)

(72) Inventors: Mahmoud Niroo Jazi, San Diego, CA (US); Marc Supinski, Toronto (CA); Mihai Tazlauanu, North York (CA)

(73) Assignee: PERASO TECHNOLOGIES INC., Toronto (CA)

( * ) Notice: Subject to any disclaimer, the term of this patent is extended or adjusted under 35 U.S.C. 154(b) by 178 days.

(21) Appl. No.: 17/005,978

(22) Filed: Aug. 28, 2020

(65) Prior Publication Data

US 2021/0066804 A1 Mar. 4, 2021

Related U.S. Application Data

(60) Provisional application No. 62/894,807, filed on Sep. 1, 2019.

(51) Int. Cl.

| | |
|---|---|
| ***H01Q 1/24*** | (2006.01) |
| ***H01Q 9/04*** | (2006.01) |
| ***H01Q 19/00*** | (2006.01) |

(52) U.S. Cl.

CPC ..... *H01Q 9/045* (2013.01); *H01Q 9/0414* (2013.01); *H01Q 19/005* (2013.01)

(58) Field of Classification Search

CPC ..... H01Q 9/045; H01Q 9/0414; H01Q 19/005

See application file for complete search history.

(56) References Cited

U.S. PATENT DOCUMENTS

| | | | | |
|---|---|---|---|---|
| 2014/0145883 | A1* | 5/2014 | Baks | H01L 23/66 343/700 MS |
| 2020/0303822 | A1* | 9/2020 | Yao | H01L 23/66 |
| 2021/0050651 | A1* | 2/2021 | Jung | H01Q 1/243 |

FOREIGN PATENT DOCUMENTS

| | | | | |
|---|---|---|---|---|
| WO | WO-2017141698 A1 * | 8/2017 | | H01Q 1/52 |

* cited by examiner

*Primary Examiner* — Dieu Hien T Duong

(74) *Attorney, Agent, or Firm* — Perry + Currier

(57) ABSTRACT

A wireless communications module includes: a primary board including (i) a first surface bearing a radio controller, and defining a set of control contacts for connection to respective ports of the radio controller, and (ii) a second surface opposite the first surface; an antenna array integrated with the primary board, the antenna array including a plurality of unit cells each having: an inverted-L antenna having a planar element adjacent to the second surface of the primary board, and an orthogonal element extending from the planar element to a feed layer within the primary board; and a passive patch element between the planar element and the feed layer.

13 Claims, 6 Drawing Sheets

MILLIMETER-WAVE PHASED-ARRAYS WITH INTEGRATED ARTIFICIALLY PILLOWED INVERTED-L ANTENNAS

CROSS-REFERENCE TO RELATED APPLICATIONS

The present application claims priority to U.S. provisional application No. 62/894,807, filed Sep. 1, 2019, the contents of which are incorporated herein by reference.

FIELD

The specification relates generally to wireless communications, and specifically to millimeter-wave phased-arrays with integrated artificially pillowed inverted-L antennas.

BACKGROUND

The performance of wireless antenna arrays (e.g. including sets of printed antenna elements) is dependent, in part, on the precision of antenna geometry and on the characteristics of the antenna substrate—the material between the antenna elements and the ground layer, which is typically a dielectric material supporting the antenna elements. Certain substrate materials, as well as assembly configurations, have superior performance characteristics to others, but may also be costlier to fabricate, have larger physical footprints, and the like.

SUMMARY

An aspect of the specification provides a wireless communications module includes: a primary board including (i) a first surface bearing a radio controller, and defining a set of control contacts for connection to respective ports of the radio controller, and (ii) a second surface opposite the first surface; an antenna array integrated with the primary board, the antenna array including a plurality of unit cells each having: an inverted-L antenna having a planar element adjacent to the second surface of the primary board, and an orthogonal element extending from the planar element to a feed layer within the primary board; and a passive patch element between the planar element and the feed layer.

Another aspect of the specification provides a unit cell for a wireless communications module, the unit cell comprising: an inverted-L antenna having a planar element adjacent to the second surface of the primary board, and an orthogonal element extending from the planar element to a feed layer within the primary board; and a passive patch element between the planar element and the feed layer.

BRIEF DESCRIPTIONS OF THE DRAWINGS

Embodiments are described with reference to the figures listed below.

DETAILED DESCRIPTION

Figure 1A:
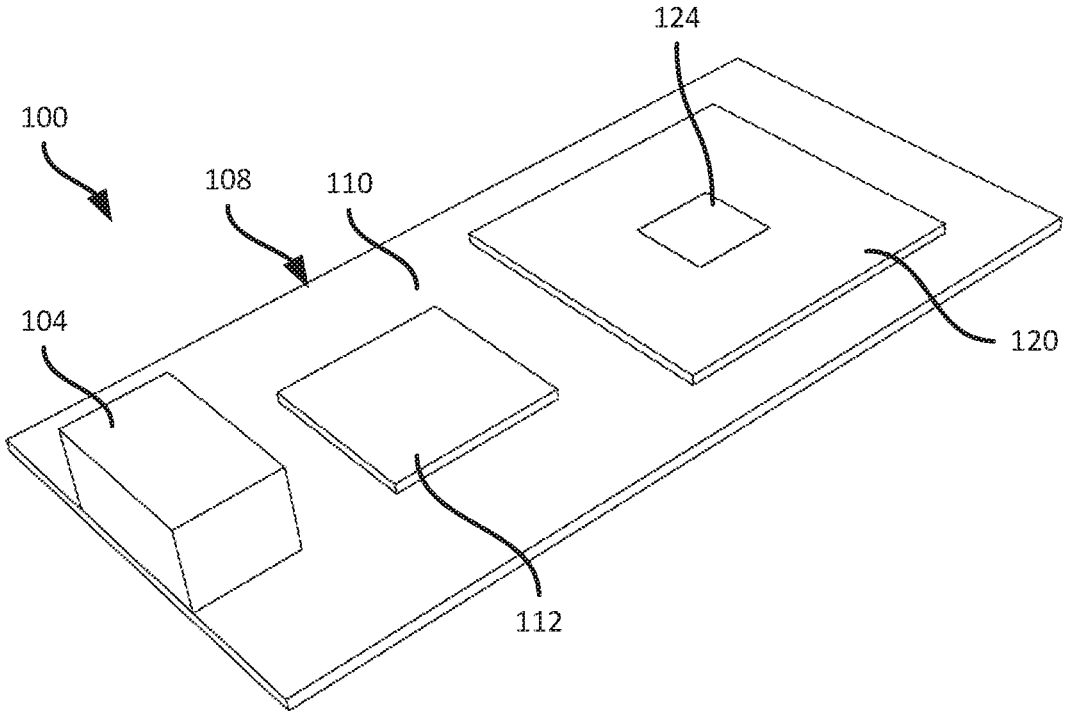
FIGS. 1A and 1B depict perspective views of a communications assembly, from above and below, respectively.

FIG. 1A depicts an example wireless communications assembly 100, also referred to as a radio frequency (RF) module 100 or simply the module 100, in accordance with the teachings of this disclosure. The module 100, in general, is configured to enable wireless data communications between computing devices (not shown). In the present example, the wireless data communications enabled by the module 100 are conducted according to the Institute of Electrical and Electronics Engineers (IEEE) 802.11ay standard, also referred to as the second WiGig standard, which employs frequencies of about 57 GHz to about 71 GHz, across six channels, each with a bandwidth of 2.16 GHz (centered at frequencies of 58.32 GHz, 60.48 GHz, 62.64 GHz, 64.8 GHz, 66.96 GHz, and 69.12 GHz) and which includes multiple-input-multiple-output (MIMO) functionality with up to 4 streams. As will be apparent, however, the module 100 may also enable wireless communications according to other suitable standards, employing other frequency bands.

RF modules configured to communicate via standards such as WiGig may be subject to competing constraints. A first example of such constraints includes strict fabrication tolerances to provide desired performance attributes such as antenna bandwidth (e.g. to cover all six of the above-mentioned channels). A second example constraint is a reduction in production complexity and cost. As will be apparent to those skilled in the art, the above constraints may be in conflict, in that fabricating wireless communications assemblies to satisfy strict tolerances tends to increase cost and complexity of fabrication. As will be discussed below, the module 100 includes various features to enable the provision of certain desirable performance attributes (such as full spectrum coverage of the WiGig frequency band) while mitigating the impact on fabrication cost and complexity that would typically be associated with such performance attributes.

The module 100 can be integrated with a computing device, or in other examples, can be implemented as a discrete device that is removably connected to a computing device. In examples in which the module 100 is configured to be removably connected to a computing device, the module 100 includes a communications interface 104, such as a Universal Serial Bus (USB) port, configured to connect the remaining components of the module 100 to a host computing device (not shown).

The module 100 includes a primary board 108, which may also be referred to as a primary support. In the present example, the primary board 108 is a printed circuit board (PCB), for example fabricated with FR4 material, carrying either directly or via additional boards, the remaining components of the module 100. In particular, the primary board 108 carries, e.g. on a first surface 110 thereof, the above-mentioned communications interface 104.

The primary board 108 also carries, on the first surface 110, a baseband controller 112. The baseband controller 112 is implemented as a discrete integrated circuit (IC) in the present example, such as a field-programmable gate array (FPGA). In other examples, the baseband controller 112 may be implemented as two or more discrete components. In further examples, the baseband controller 112 can be integrated within the primary board 108 (i.e. be defined within the conductive layers of the primary board 108) rather than carried on the first surface 110.

In the present example, the baseband controller 112 is connected to the primary board 108 via any suitable surface-mount package, such as a ball-grid array (BGA) package that electrically couples the baseband controller 112 to signal paths (also referred to as leads, traces and the like) formed within the primary board 108 and connected to other components of the module 100. For example, the primary board 108 defines signal paths (not shown) between the baseband controller 112 and the communications interface 104. Via such signal paths, the baseband controller 112 transmits data received at the module 100 to the communications interface for delivery to a host computing device, and also receives data from the host computing device for wireless transmission by the module 100 to another computing device. Further, the primary board 108 defines additional signals paths extending between the baseband controller 112 and further components of the module 100, to be discussed below.

The module 100 further includes an interposer 120 carrying a radio controller 124. The interposer 120 is a discrete component mounted on the first surface 110 via a suitable surface-mount package (e.g. BGA). The interposer 120 itself carries the radio controller 124, and contains signal paths (also referred to as feed lines) for connecting control ports of the radio controller 124 to the baseband controller 112, and for connecting further control ports of the radio controller 124 to antenna elements to be discussed in greater detail below. The radio controller 124 may, for example, be placed onto or into the interposer 120 via a pin grid array or other suitable surface-mount package. In other examples, the radio controller 124 may be mounted directly on the first surface 110, e.g. via a BGA package, rather than being supported by the interposer 120.

The module 100 can also include a heatsink (not shown) placed over the baseband controller 112, the interposer 120 and the radio controller 124, and in contact with surfaces of those components, e.g. to exhaust heat generated by the components. In other examples, separate heat sinks may be placed over the baseband controller 112, and the combination of the interposer 120 and radio controller 124.

The radio controller 124 includes a transmit and a receive port for connection, e.g. via the interposer 120 and traces defined by the primary board 108, to the baseband controller 112. The radio controller 124 also includes a plurality of antenna ports for connection, via the interposer 120, to corresponding contacts on the first surface 110 of the primary board 108. Those contacts, in turn, are connected to elements of an antenna array integrated with the primary board 108, to carry signals between the radio controller 124 and the above-mentioned antenna elements. The construction of the antenna array itself will be described in greater detail further below.

Figure 1B:
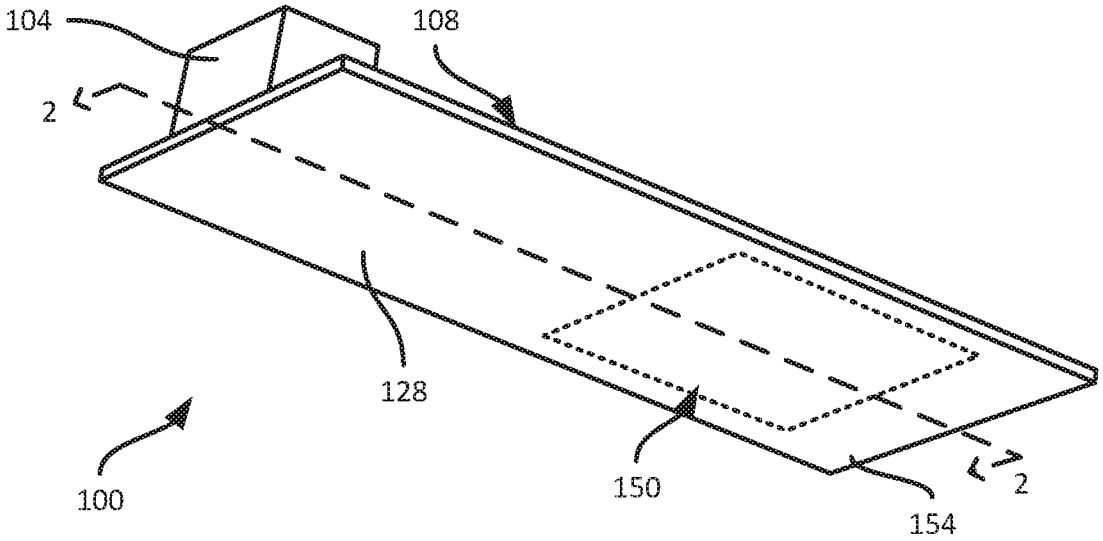

Turning to FIG. 1B, a second surface 128 of the primary board 108 is shown opposite the first surface 110. The above-mentioned antenna elements are contained within an antenna assembly 150 that implements a phased array of antenna elements. As will be apparent to those skilled in the art, millimeter-wave phased arrays can be used to implement relatively low-cost solutions to the problems of high propagation loss and link blockage associated with wireless communications over the 60 GHz frequency band (e.g. utilizing the above-mentioned 802.11 ay standard).

Such phased arrays include a set of radiating elements, also referred to as unit cells (UCs) controllable to for creating a beam of radio waves that can be electronically steered in different directions, without mechanical movement. Individual UCs are fed with respective RF signals having phase relationships such that the radio waves from the separate array elements add together to increase the radiation in a desired direction. Achieving sufficient gain and bandwidth coverage with such systems, while minimizing fabrication cost and complexity, may be challenging. For example, obtaining sufficient gain and bandwidth coverage using low-cost system-in-package (SiP) architecture and relatively thick board configurations (e.g. greater overall thickness than 1 mm, i.e. larger than $0.4\lambda_g$, where $\lambda_g$ is the guided wavelength at 71 GHz) further complicates the design of such systems.

The antenna assembly 150 is integrated with the primary board 108 and adjacent to the second surface 128. For example, as will be discussed in greater detail below, the antenna assembly 150 can include an eight-layer portion of the primary board 108, beginning at the second surface 128. The primary board 108 itself may include a greater number of layers than eight (or any other suitable number of layers employed by the antenna assembly 150). The antenna assembly 150 includes various features, to be discussed below in greater detail, enabling suitable performance for WiGig use to be achieved by the antenna assembly 150, while also enabling relatively low-cost fabrication of the antenna assembly 150 along with the remainder of the primary board 108.

Figure 2:
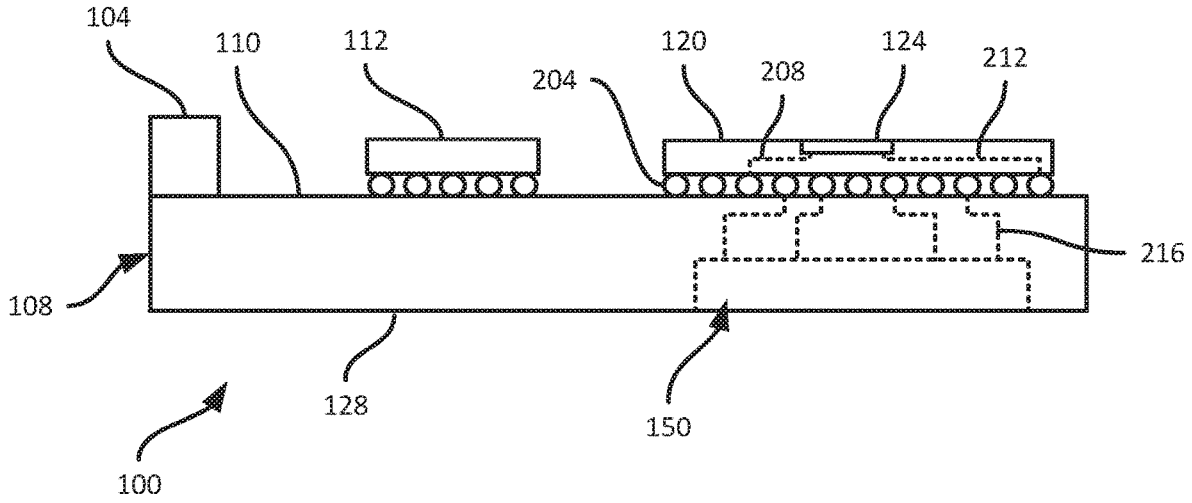
FIG. 2 depicts a cross-section of the system of FIG. 1.

Turning to FIG. 2, the cross-section 2-2 indicated in FIG. 1B is illustrated. As seen in FIG. 2, the interposer 120 is connected to the first surface 110 via a surface-mount package 204, which in the present example is a BGA package. The interposer 120 contains a plurality of internal feed lines, examples 208 and 212 of which are shown in FIG. 2, connecting control ports of the radio controller 124 to elements of the package 204 for electrical connection with control contacts on the first surface 110. At least a portion of the control contacts on the first surface 110 are connected to conduits (four example conduits 216 are shown) extending through the primary board 108 from the first surface 110 to the antenna assembly 150, which is adjacent to the second surface 128. In the illustrated example, the antenna assembly 150 forms a portion of the second surface 128. That is, some components of the antenna assembly 150 are at the second surface 128.

The conduits 216, also referred to as a feed network, convey signals from the radio controller 124 to the antenna assembly 150, which may include further internal conduits to route signals from the conduits 216 to individual elements of the antenna assembly 150. The conduits 216 may be implemented, for example, as strip lines.

Figure 3:
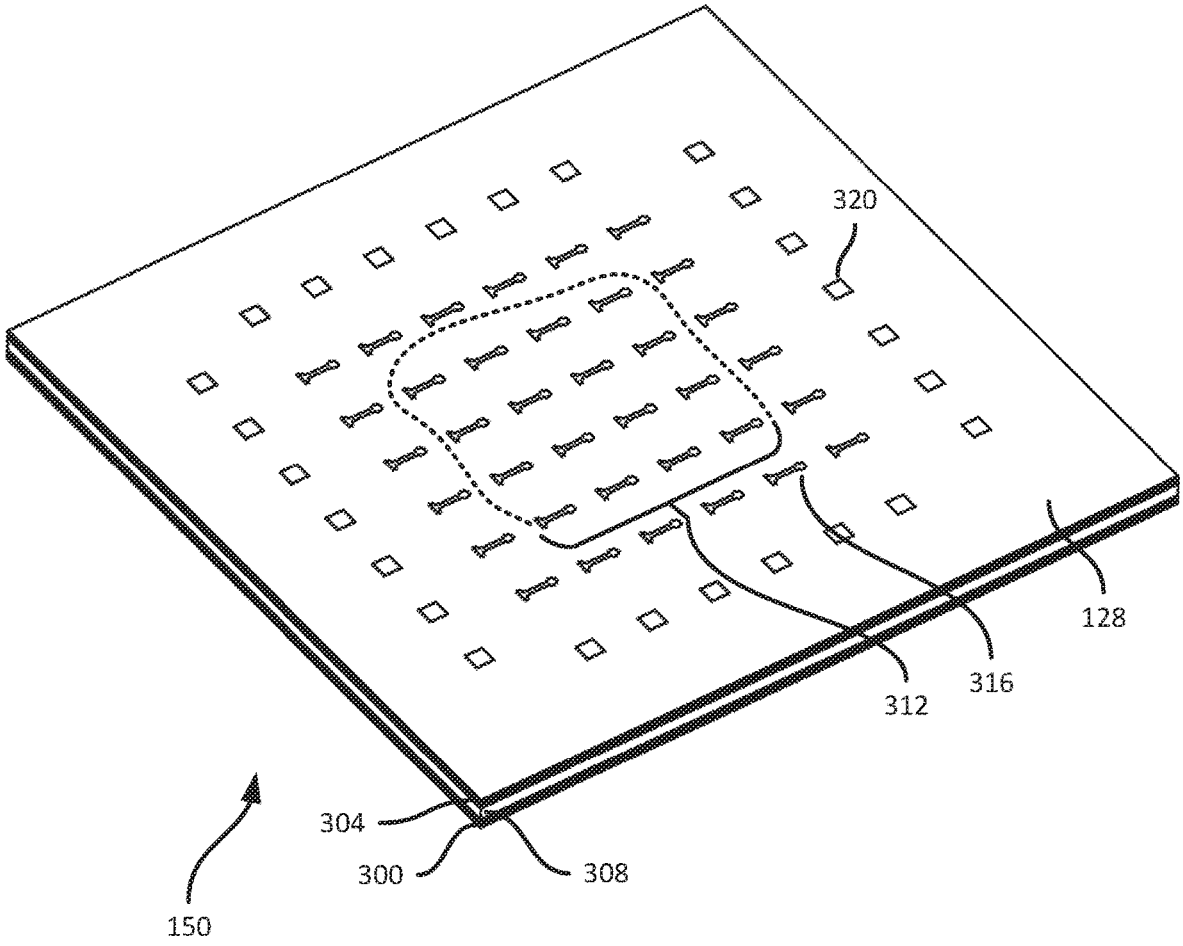
FIG. 3 is an isometric view of the antenna assembly of the system of FIG. 1, viewed from a first side.

Turning to FIG. 3, the antenna assembly 150 is shown in isolation, reversed from the orientation shown in FIGS. 1A, 1B and 2, such that the second surface 128 faces upwards. The antenna assembly 150, in the illustrated example, includes a first set of layers (e.g. three pre-preg layers separated by conductive material such as copper plate) 300, also referred to as an inner set 300 because the inner set 300 is further from the second surface 128 and closer to the first surface 110. The assembly 150 also includes a second set of layers 304 (e.g. another three layers of pre-preg), also referred to as the outer set 304. The inner and outer sets 300 and 304 are separated by a core layer 308, e.g. of a dielectric such as FR4 or the like. The outer set 304 defines certain components of the assembly 150, including a set 312 of unit cells.

Each unit cell among the set 312, as will be described below in greater detail, is an artificially pillowed inverted-L antenna. The assembly 150 also includes a plurality of "dummy" unit cells 316, with the same physical structure as the unit cells in the set 312. The dummy unit cells, however, are not active (i.e. they are not connected to the radio controller 124). The set 312, in the present example, includes a 4×4 array of active unit cells, and the dummy unit cells 316 include a set of twenty dummy unit cells surrounding (i.e. forming a perimeter around) the set 312. The passive dummy unit cells 316 mimic an infinite environment for the active unit cells (i.e. those of the set 312). In other examples, the dummy unit cells 316 may be reduced in number or omitted. In further examples, the dummy unit cells 316 may be provided in greater number, for example as a second perimeter including twenty-eight dummy unit cells 316 (e.g. a square perimeter two unit cells wide).

Although the unit cells 312 and the dummy unit cells 316 are shown as being arranged in a square grid, in other examples, the unit cells may be deployed in other arrangements, including rectangular grids.

The set 312 of active unit cells, as well as the passive unit cells 316, are adjacent to the second surface 128 or at the second surface 128. As will be illustrated in subsequent drawings, in the present embodiment the second surface 128 is formed by a protective layer overlaid onto the unit cells, and the unit cells are therefore adjacent to the second surface 128 (i.e. separated by a single layer of material, e.g. a protective epoxy). In other embodiments, the protective layer may be omitted, and the unit cells may be directly on the second surface 128 (i.e. exposed to the environment).

The assembly 150 can also include, on or adjacent to the second surface 128, a plurality of passive patches 320, which are metallic patches employed to balance the metal density of different layers. In the present example, the assembly 150 includes additional patches stacked with those visible in FIG. 3, e.g. on respective layers of the second set of layers 304.

Figure 4:
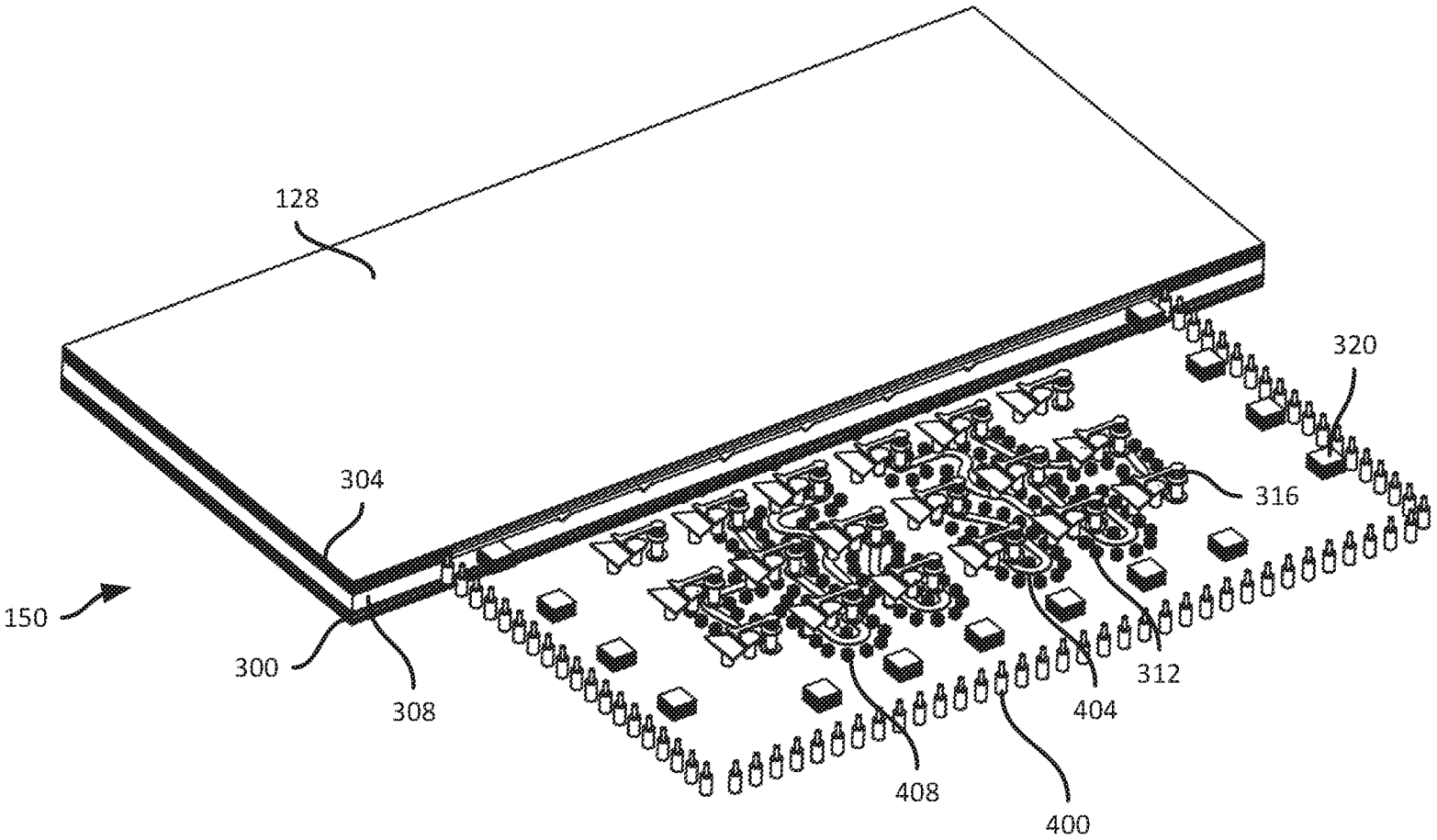
FIG. 4 is an isometric view of the antenna assembly of the system of FIG. 1, illustrating internal components using hidden lines FIG. 5. is a diagram illustrating the antenna assembly of FIG. 3, viewed from a second side opposite the side shown in FIG. 3, showing signal and shielding structures within the antenna assembly.

Turning to FIG. 4, the assembly 150 is shown with the substrate (i.e. the inner and outer sets of layers 300 and 304, and the core 308) sectioned to reveal various internal components of the assembly 150. In particular, the unit cells 312 and 316, implemented within the outer set of layers 304, are visible, as are the stacked patches 320 (also implemented within the outer set of layers 304, adjacent to the second surface 128).

In addition, the assembly 150 includes a plurality of shielding vias 400, e.g. around a perimeter of the assembly 150 and extending from the core 308 to the second surface 128. The shielding vias 400 define a confinement area within the primary board 108 for the array of unit cells 312 and 316, by suppressing propagation of undesired modes inside the parallel metallic plates between the layers 300, 304 and 308.

Also visible in FIG. 4 are a plurality of strip line elements 404 defining the feed network for the active unit cells 312. The strip lines 404, in other words, connect the conduits 216 mentioned earlier with the active unit cells 312, and are defined within the inner set of layers 300. The assembly 150 therefore includes vias traversing the core 308 between the strip lines 404 and the unit cells 312. In the present example, the assembly 150 also includes a set of strip line shielding vias 408 bordering the strip lines 404.

Figure 5:
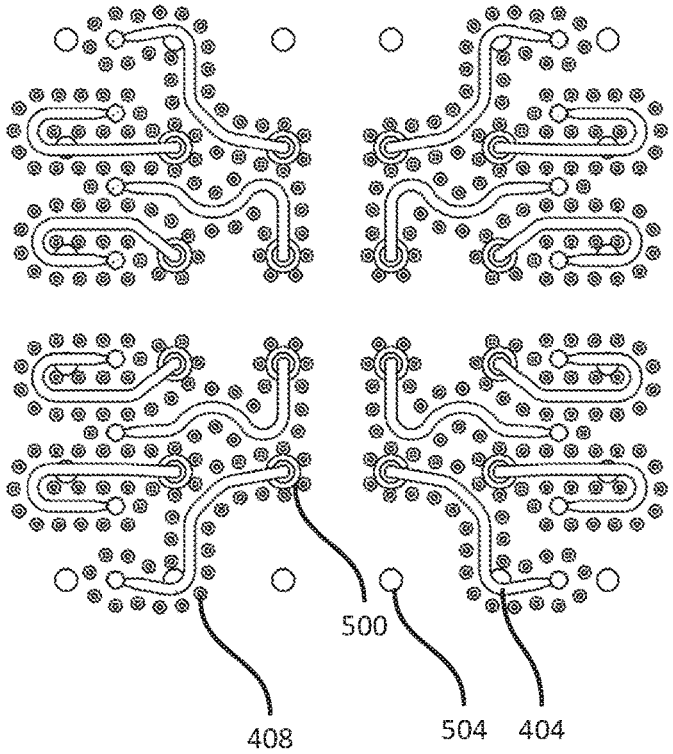

FIG. 5 illustrates a plane view of the assembly 150 viewed from the side of the inner set of layers 300, omitting the layers 300 themselves to reveal the strip lines 404 and pads 500 connecting the strip lines 404 to the unit cells 312 (not visible in FIG. 5). As seen in FIG. 5, pads 504 connected to the dummy unit cells 316 are not connected to the strip lines 404.

Figure 6A:
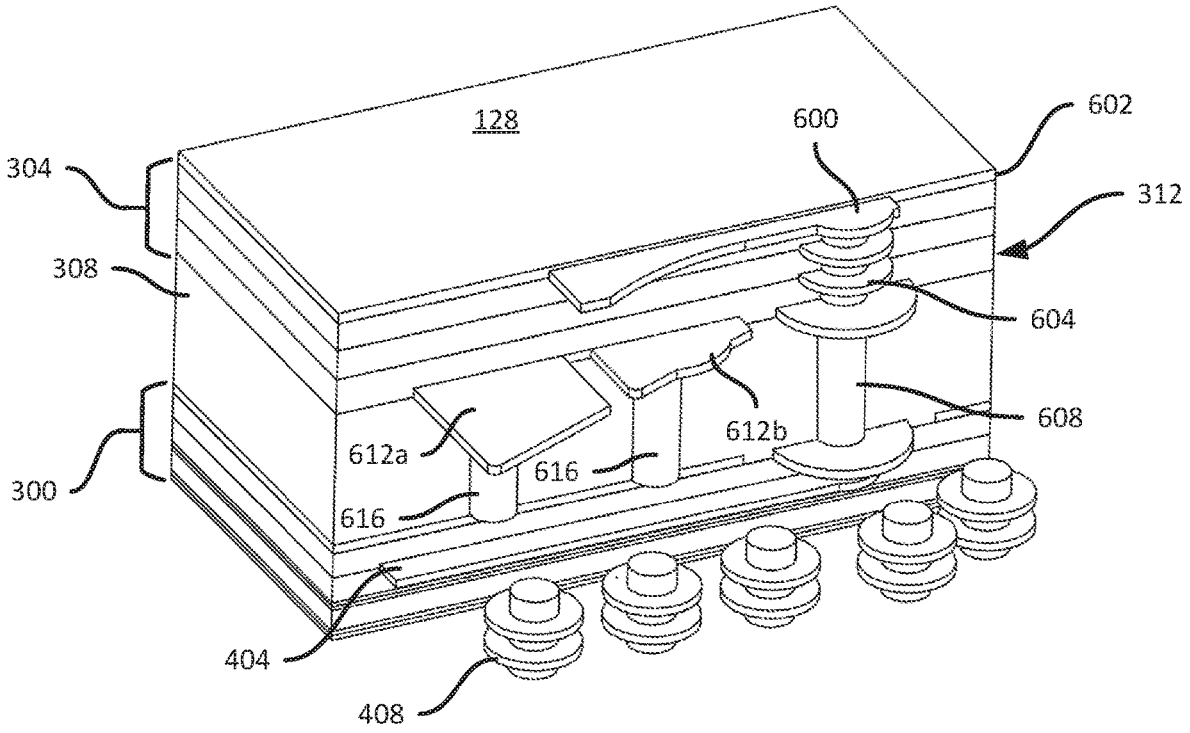
FIG. 6A is a partial cross section of one unit cell of the antenna assembly of FIG. 3.
Figure 6B:
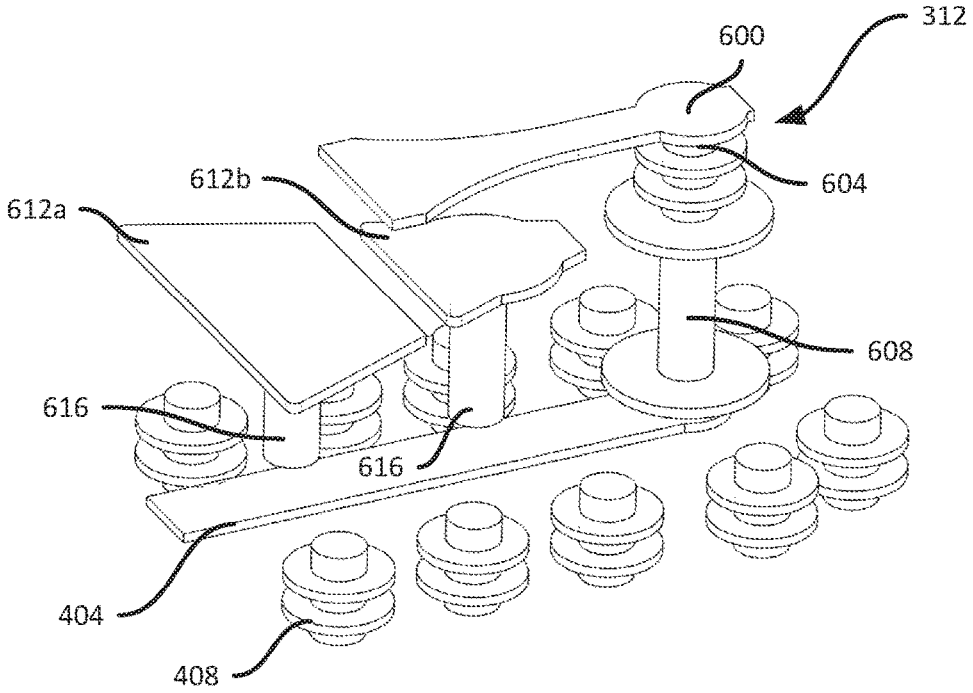
FIG. 6B is a diagram illustrating certain internal components of the unit cell of FIG. 6A, omitting substrate layers.

Turning to FIG. 6A, a partial cross section of a single unit cell 312 and supporting infrastructure is illustrated. FIG. 6B illustrates the unit cell 312 and supporting infrastructure in isolation.

The unit cell 312 includes an inverted-L antenna, in the form of a planar element 600 parallel to the second surface 128 and adjacent to the second surface (in the present example, below a protective layer 602 forming the second surface 128) and an orthogonal element 604, such as one or more laser-drilled vias and corresponding pads, extending away from the second surface 128 (i.e. into the assembly 150, towards the first surface 110). The antenna is coupled to the strip line 404 by a via 608.

An array of inverted-L antennas may be vulnerable to variable input impedance when its beam is scanned, due to coupling between elements and excitation of surface waves. The unit cell 312 therefore also includes at least one passive patch element between the planar element 600 and the strip line 404. In the present example, the unit cell 312 includes two shortened passive patches 612*a* and 612*b*, defined in the outer set of layers 304 but further into the assembly 150 than the planar element 600 (that is, between the planar element 600 and the feed layer(s) containing the strip line 404). The passive patches 612 can be connected to a ground layer by vias 616.

The passive patches 612 artificially pillow the inverted-L antenna, and therefore mitigate variation of the active input impedance of the antenna, particularly at higher frequencies such as those used in WiGig. Such mitigation may be particularly effective when the beam is scanned in the H-plane. The pillowing effect provided by the patches 612 reduces the effective height (thickness) of the substrate, and thereby avoids efficient excitation of surface waves. This, in turn, stabilizes the radiation pattern produced by the assembly 150 over the target bandwidth. Although the inverted-L antenna formed by the elements 600 and 604 is the dominant resonator, the shortened patches 612 also contribute to the radiation over the matched bandwidth, making the unit cell 312 a hybrid radiating element.

The physical dimensions of the assembly 150 may vary with the specific application and fabrication techniques selected for the assembly. In the illustrated example, the total thickness of the outer set of layers 304 and the core 308 is about $0.35\lambda_g$ ($\lambda_g$ being the guided wavelength at 71 GHz).

The unit cells 312, and their use in the arrangements discussed above and shown in FIGS. 3 and 4, permit the deployment of a module 100 with alleviated sensitivity to TM-mode scan angles at higher frequencies (e.g. those employed by the WiGig standard, particularly the upper channels thereof). The module 100 may also provide stable performance over the full six WiGig channels for TE-mode operation. Modules 100 employing the structures discussed herein can implement WiGig communications with a gain of about 15 dBi and conical scan range of at least +/−30 degrees with a gain drop that does not exceed 2 dB at extreme angles.

The scope of the claims should not be limited by the embodiments set forth in the above examples, but should be given the broadest interpretation consistent with the description as a whole.

The invention claimed is:

1. A wireless communications module, comprising:

a primary board including (i) a first surface bearing a radio controller, and defining a set of control contacts for connection to respective ports of the radio controller, and (ii) a second surface opposite the first surface;

an antenna array integrated with the primary board, the antenna array including a core layer between an inner set of conductive layers and an outer set of conductive layers, wherein the outer set of conductive layers is between the core layer and the second surface, the antenna array further including a plurality of unit cells each having:

an inverted-L antenna having (i) a planar element on an outermost one of the outer set of conductive layers, adjacent to the second surface of the primary board, and (ii) an orthogonal element extending from the planar element to a feed layer within the inner set of conductive layers; and a passive patch element in the outer set of conductive layers, between the planar element and the core layer the passive patch element connected to a ground layer in the inner set of conductive layers.

2. The wireless communications module of claim 1, wherein each unit cell includes a second passive patch element between the planar element and the feed layer.

3. The wireless communications module of claim 2, wherein the passive patch element and the second passive patch element are defined on the same layer of the outer set.

4. The wireless communications module of claim 1, wherein the plurality of unit cells are arranged in a grid.

5. The wireless communications module of claim 4, wherein the antenna array further includes a plurality of passive unit cells disconnected from the feed layer.

6. The wireless communications module of claim 4, wherein the passive unit cells are arranged in a perimeter about the grid.

7. The wireless communications module of claim 1, further comprising a plurality of passive patch elements surrounding the plurality of unit cells.

8. The wireless communications module of claim 1, further comprising: a baseband controller on the first surface of the primary board.

9. The wireless communications module of claim 1, further comprising: a communications interface on the first surface of the primary board, connected to the baseband controller.

10. A unit cell for a wireless communications module, the unit cell comprising:

an inverted-L antenna integrated with a primary board having (i) a first surface bearing a radio controller, (ii) a core layer between an inner set of conductive layers and an outer set of conductive layers, the outer set of conductive layers between the core layer and a second surface opposite the first surface;

the inverted-L antenna having aa planar element on an outermost one of the outer set of conductive layers, adjacent to the second surface of the primary board, and (ii) an orthogonal element extending from the planar element to a feed layer within the inner set of conductive layers; and a passive patch element in the outer set of conductive layers, between the planar element and the core layer, the passive patch element connected to a ground layer in the inner set of conductive lavers.

11. The unit cell of claim 10, wherein the orthogonal element includes at least one lasered via and a corresponding pad.

12. The unit cell of claim 10, further comprising: a second passive patch element between the planar element and the feed layer.

13. The unit cell of claim 12, wherein the passive patch element and the second passive patch element are defined on the same layer of the outer set.

* * * * *